US007708084B2

(12) United States Patent
Duesselberg et al.

(10) Patent No.: US 7,708,084 B2
(45) Date of Patent: May 4, 2010

(54) PORTABLE POWER DRILL WITH GEARBOX

(75) Inventors: Achim Duesselberg, Hangzhou (CN); Andre Ullrich, Filderstadt-Bernhausen (DE); Kurt Sieber, Leinfelden-Echterdingen (DE); Thomas Brinkmann, Filderstadt (DE)

(73) Assignee: Robert Bosch GmbH, Stuttgart (DE)

( * ) Notice: Subject to any disclaimer, the term of this patent is extended or adjusted under 35 U.S.C. 154(b) by 252 days.

(21) Appl. No.: 11/719,451

(22) PCT Filed: Jul. 7, 2006

(86) PCT No.: PCT/EP2006/064022

§ 371 (c)(1),
(2), (4) Date: May 16, 2007

(87) PCT Pub. No.: WO2007/025795

PCT Pub. Date: Mar. 8, 2007

(65) Prior Publication Data

US 2009/0145617 A1 Jun. 11, 2009

(30) Foreign Application Priority Data

Aug. 31, 2005 (DE) ..... 10 2005 041 448

(51) Int. Cl.
*B25D 11/00* (2006.01)

(52) U.S. Cl. ..... 173/48; 173/47; 173/91; 173/213; 173/217

(58) Field of Classification Search ..... 173/48, 173/47, 91, 213, 217
See application file for complete search history.

(56) References Cited

U.S. PATENT DOCUMENTS

| | | | | | |
|---|---|---|---|---|---|
| 3,867,988 | A | | 2/1975 | Koehler | |
| 4,098,351 | A | * | 7/1978 | Alessio | 173/13 |
| 4,158,970 | A | | 6/1979 | Laughon | |
| 4,446,931 | A | | 5/1984 | Bleicher et al. | |
| 4,567,950 | A | * | 2/1986 | Fushiya et al. | 173/48 |
| 4,710,071 | A | | 12/1987 | Koehler et al. | |
| 5,456,324 | A | * | 10/1995 | Takagi et al. | 173/48 |
| 5,458,206 | A | * | 10/1995 | Bourner et al. | 173/178 |
| 5,531,278 | A | * | 7/1996 | Lin | 173/176 |
| 5,842,527 | A | * | 12/1998 | Arakawa et al. | 173/48 |
| 6,015,017 | A | * | 1/2000 | Lauterwald | 173/48 |
| 6,035,945 | A | * | 3/2000 | Ichijyou et al. | 173/48 |
| 6,070,675 | A | * | 6/2000 | Mayer et al. | 173/48 |
| 6,142,242 | A | * | 11/2000 | Okumura et al. | 173/48 |
| 6,176,321 | B1 | * | 1/2001 | Arakawa et al. | 173/48 |

(Continued)

FOREIGN PATENT DOCUMENTS

DE 195 81 048 10/1996

(Continued)

*Primary Examiner*—Brian D Nash
(74) *Attorney, Agent, or Firm*—Michael J. Striker

(57) ABSTRACT

A portable power drill or hammer drill having a housing (12) which consists in particular of half shells (13, 14) and accommodates a manual gearbox (26), wherein a shift element (59) that can be rotated by hand converts its rotary movement into a shift movement, can be produced cost-effectively and can be easily operated, without lubricant escaping from the housing (12), by the shift element (59) consisting of a shell-like handle part (100) which can be joined together with a further, shell-like shift part (102) in a sealing manner from outside and inside relative to a housing shell (13).

12 Claims, 9 Drawing Sheets

U.S. PATENT DOCUMENTS

| | | | | |
|---|---|---|---|---|
| 6,192,996 | B1 * | 2/2001 | Sakaguchi et al. | 173/48 |
| 6,520,267 | B2 | 2/2003 | Fuenfer et al. | |
| 6,666,284 | B2 * | 12/2003 | Stirm | 173/97 |
| 6,688,406 | B1 * | 2/2004 | Wu et al. | 173/48 |
| 6,913,090 | B2 * | 7/2005 | Droste et al. | 173/109 |
| 6,976,545 | B2 * | 12/2005 | Greitmann | 173/104 |
| 7,101,300 | B2 * | 9/2006 | Milbourne et al. | 475/265 |
| 7,124,839 | B2 * | 10/2006 | Furuta et al. | 173/104 |
| 7,264,065 | B2 * | 9/2007 | Simm et al. | 173/48 |
| 2005/0199404 | A1 * | 9/2005 | Furuta et al. | 173/48 |

FOREIGN PATENT DOCUMENTS

| | | |
|---|---|---|
| EP | 0 566 926 | 10/1993 |
| EP | 0 836 902 | 4/1998 |
| EP | 1 166 969 | 1/2002 |

* cited by examiner

PORTABLE POWER DRILL WITH GEARBOX

CROSS-REFERENCE TO RELATED APPLICATION

The invention described and claimed hereinbelow is also described in German Patent Application DE 10 2005 041 448.6 filed on Aug. 31, 2005. This German Patent Application, whose subject matter is incorporated here by reference, provides the basis for a claim of priority of invention under 35 U.S.C. 119(a)-(d).

BACKGROUND OF THE INVENTION

The present invention relates to a portable power drill or a drill hammer.

Many kinds of systems for shifting the change-speed gears of portable power drills and drill hammers are known, such as rotatable selector elements and levers with which various operating states can be selected; in these systems, the selector elements must pass through the housing wall.

To that end, it is usual to use selector elements designed as a one-piece component with complex locking contours, mounted on the gearbox. A disadvantage is that producing these complex components requires complicated, expensive tools, and the sealing between the housing wall and the selector element is problematic.

SUMMARY OF THE INVENTION

Accordingly, it is an object of the invention to provide a portable power drill with a gear box which eliminates the disadvantages of the prior art.

In keeping with these objects and with others, one feature of the present invention resides, briefly stated, in a portable power drill or drill hammer, comprising a housing composed of half-shells; a shiftable change-speed gear received in said housing and having a manually hand-rotatable selector element which converts a rotary motion into a shifting motion, said selector element having a circular shell-shaped handle part outer handle part which is joinable with a further circular shell-shaped inner selector part so as to be sealed from outside and inside relative to one of said half shells, said inner selector part having a spring which is configured as leaf spring arranged in a form-locking fashion in said inner selector part, so that it radially overlaps said selector part at both sides and is supported with both overlapping ends inside on said half-shell.

When the portable power drill is designed in accordance with the present invention it has the advantage that an economical selector element is created which can be mounted simply and securely, functions reliably, has a long life, and is sealed.

The invention is described below in further details in terms of an exemplary embodiment, in conjunction with the drawings.

DESCRIPTION OF THE PREFERRED EMBODIMENTS

Figure 1:
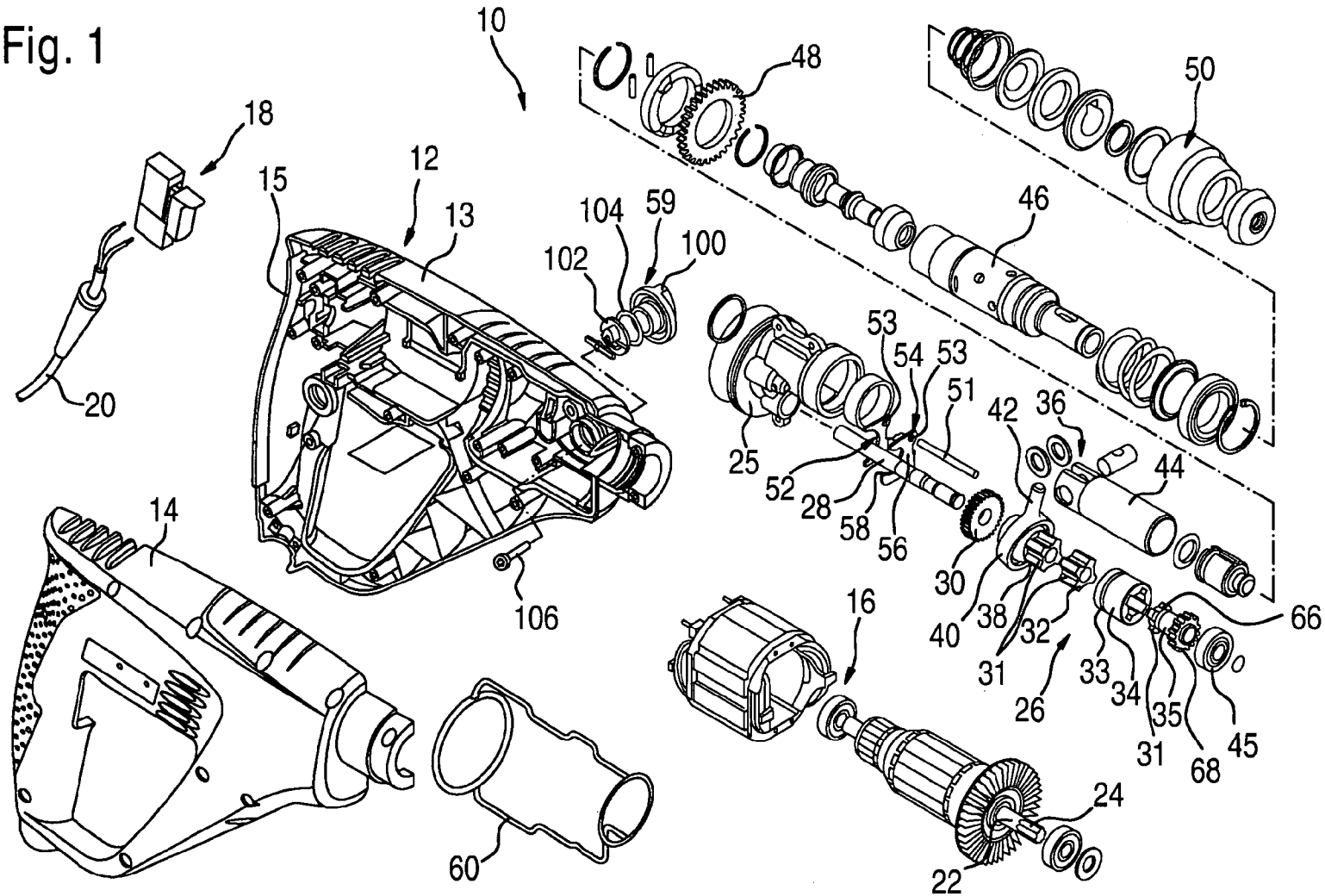
FIG. 1, an exploded drawing of the drill hammer of the invention.
Figure 2:
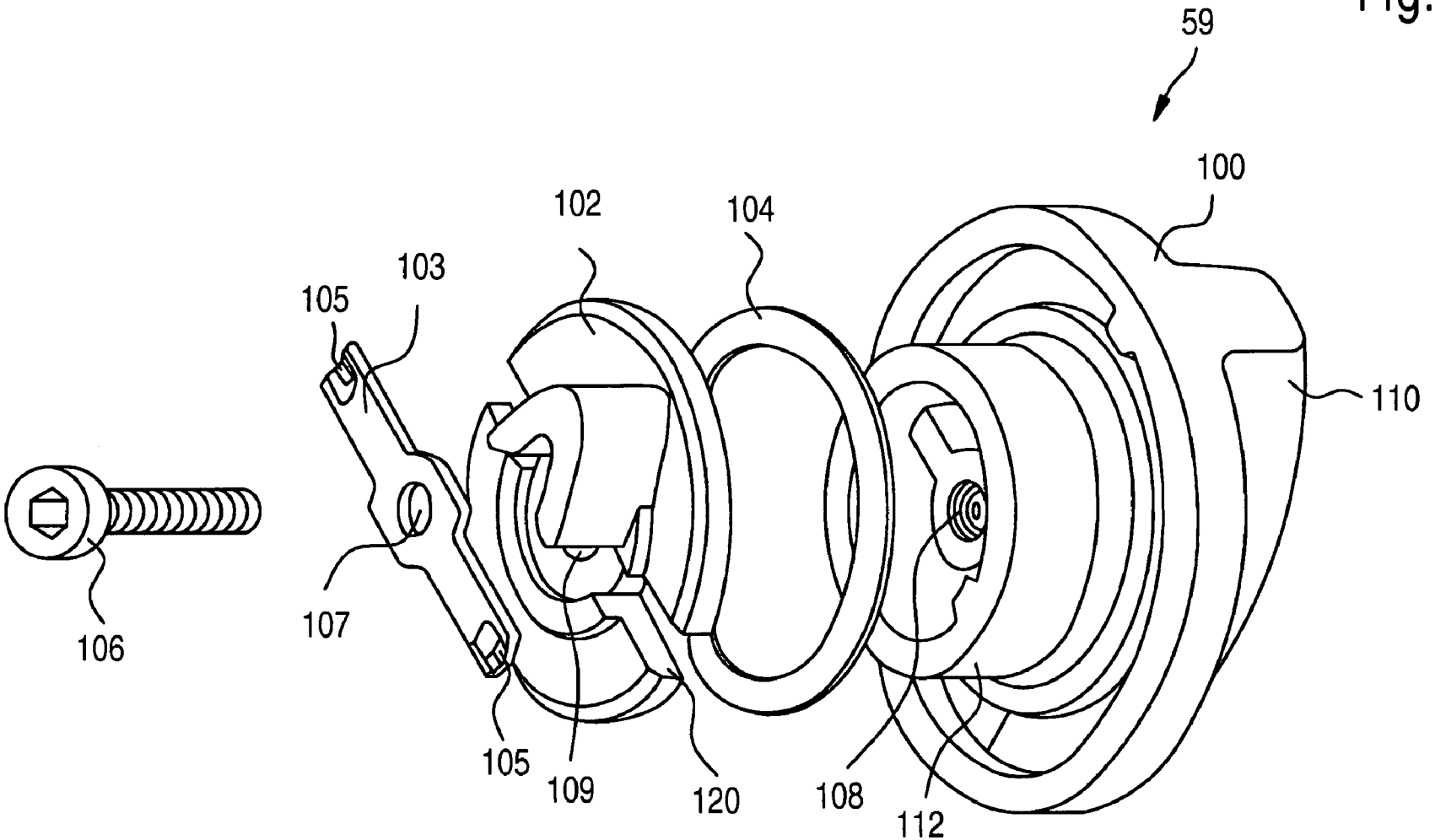
FIG. 2, an exploded drawing of the selector element.
Figure 3:
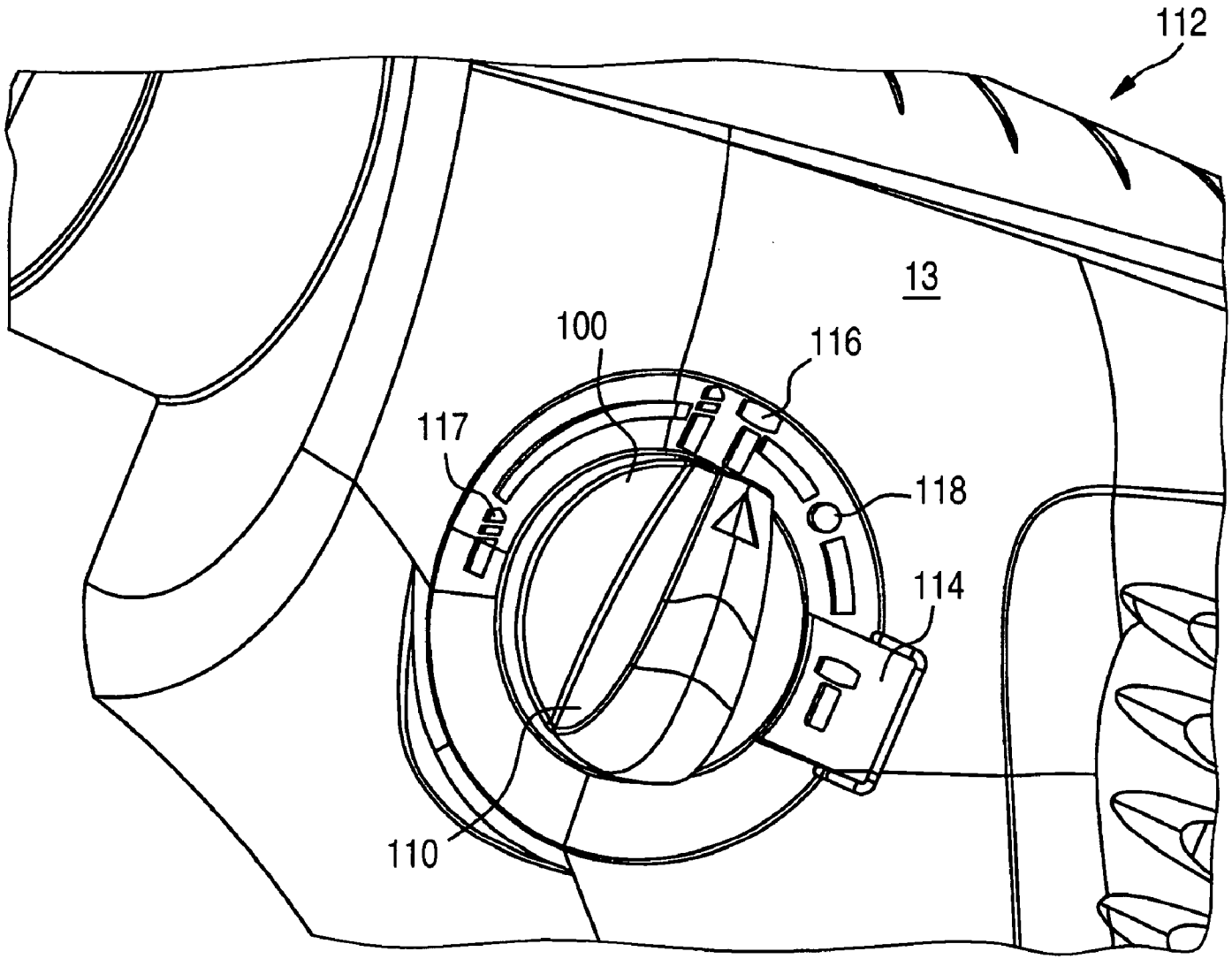
FIG. 3, an external view of a drill hammer housing provided with the selector element.
Figure 4:
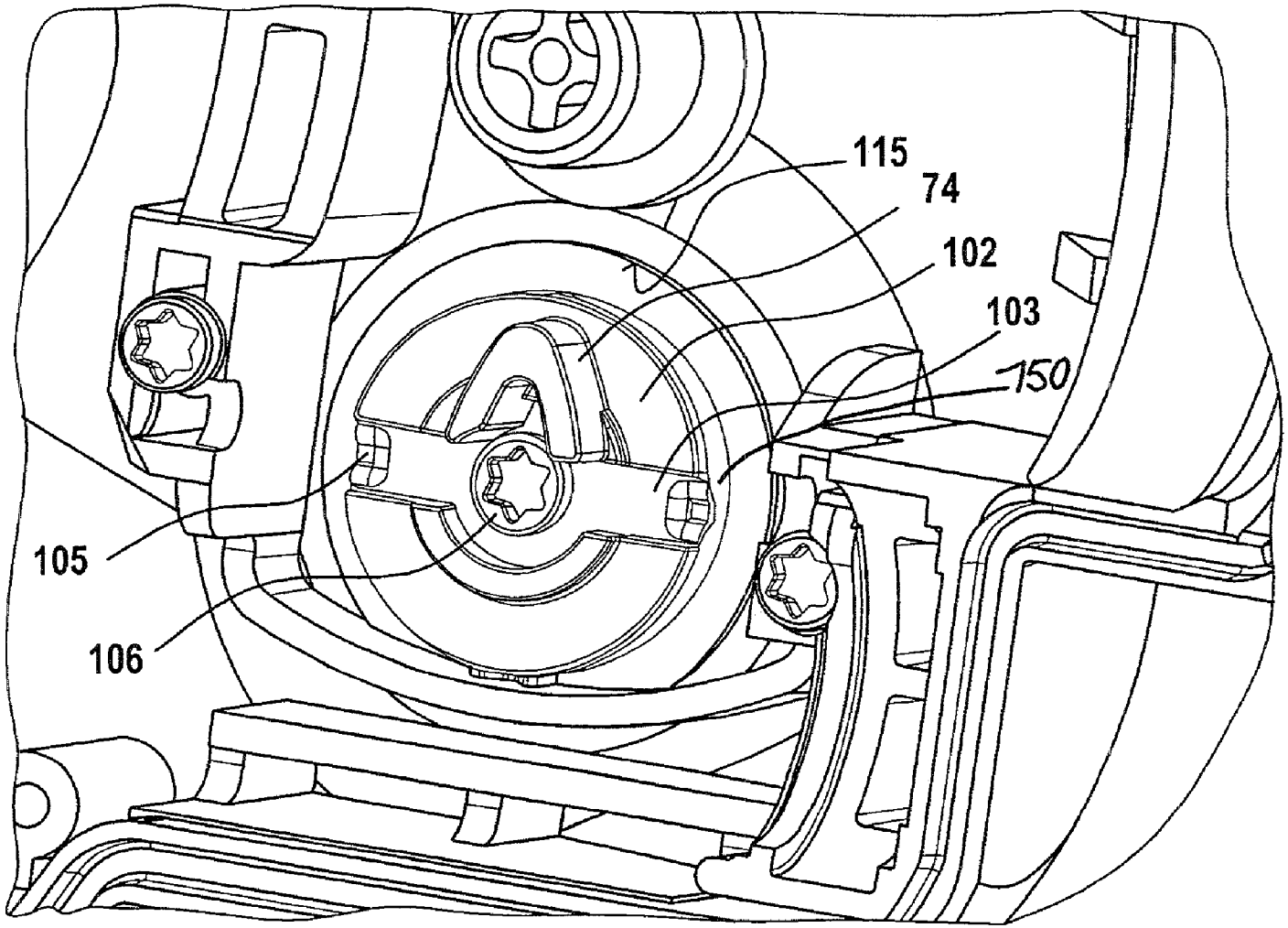
FIG. 4, an internal view of a drill hammer housing provided with the installed selector element.
Figure 5:
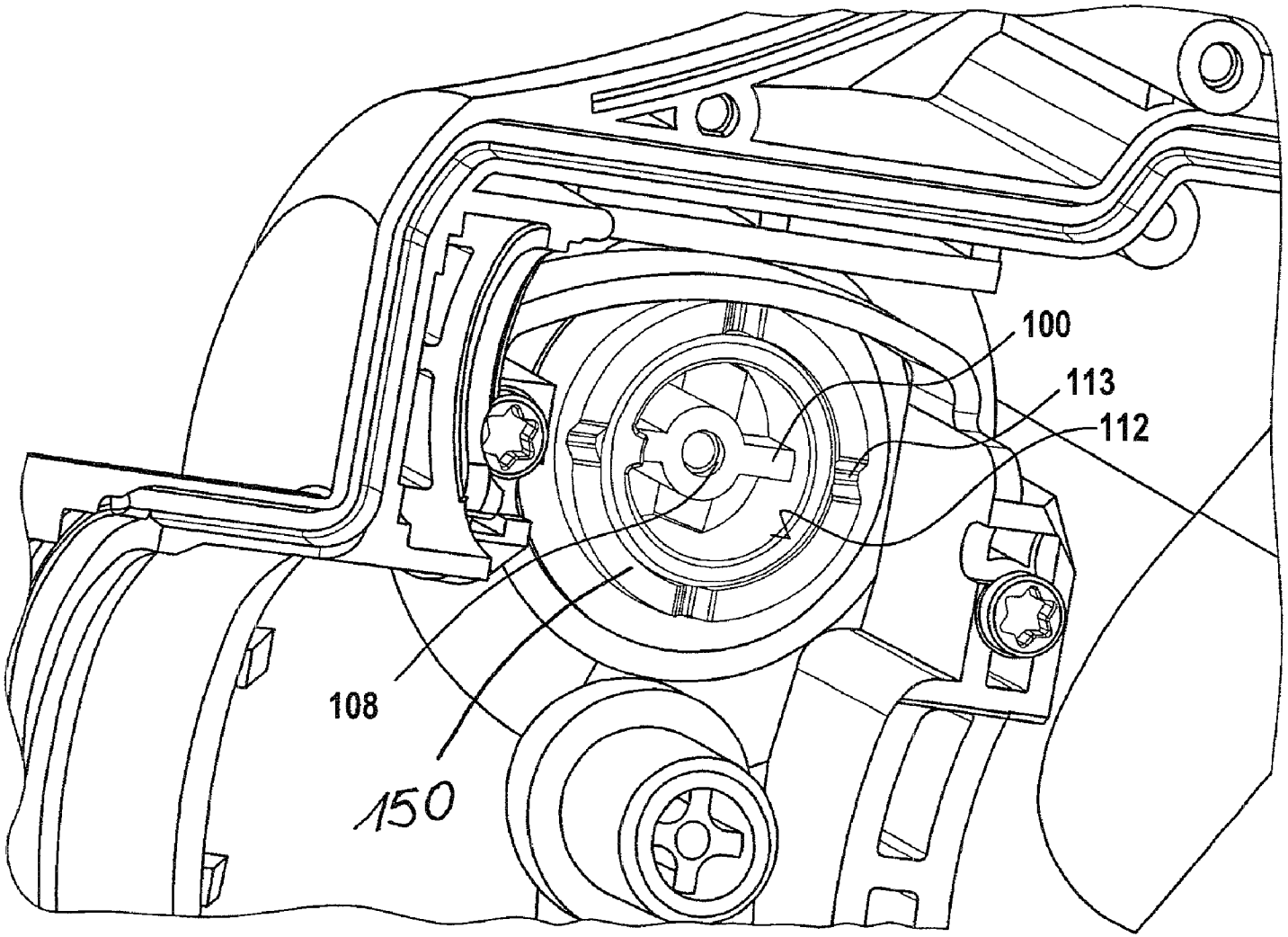
FIG. 5, an inside view of an outer part of the selector element, the outer part being positioned from outside on the drill hammer housing.
Figure 6:
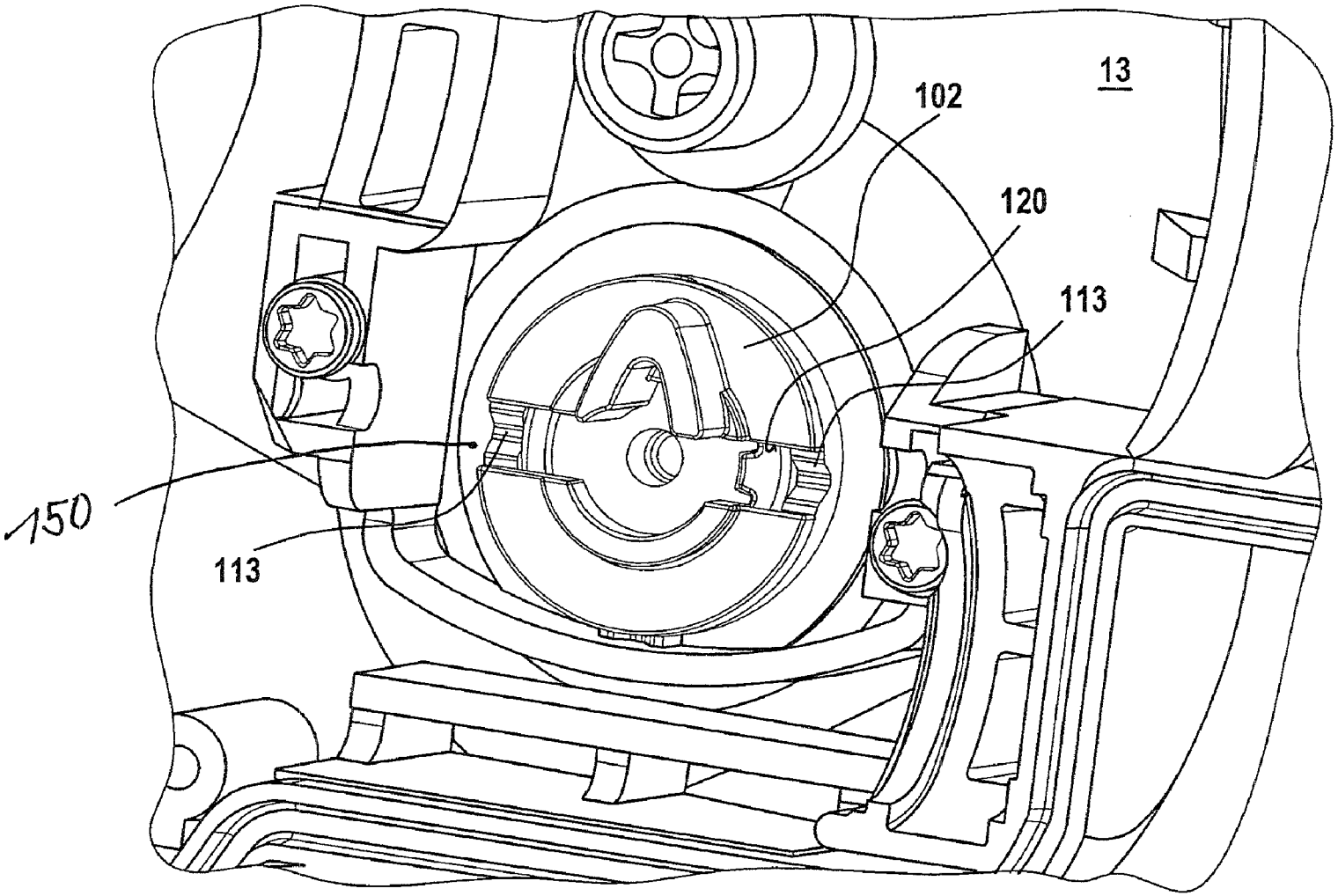
FIG. 6, an inside view of the outer and inner parts of the selector element that are seated on the drill hammer housing without a leaf spring.
Figure 7:
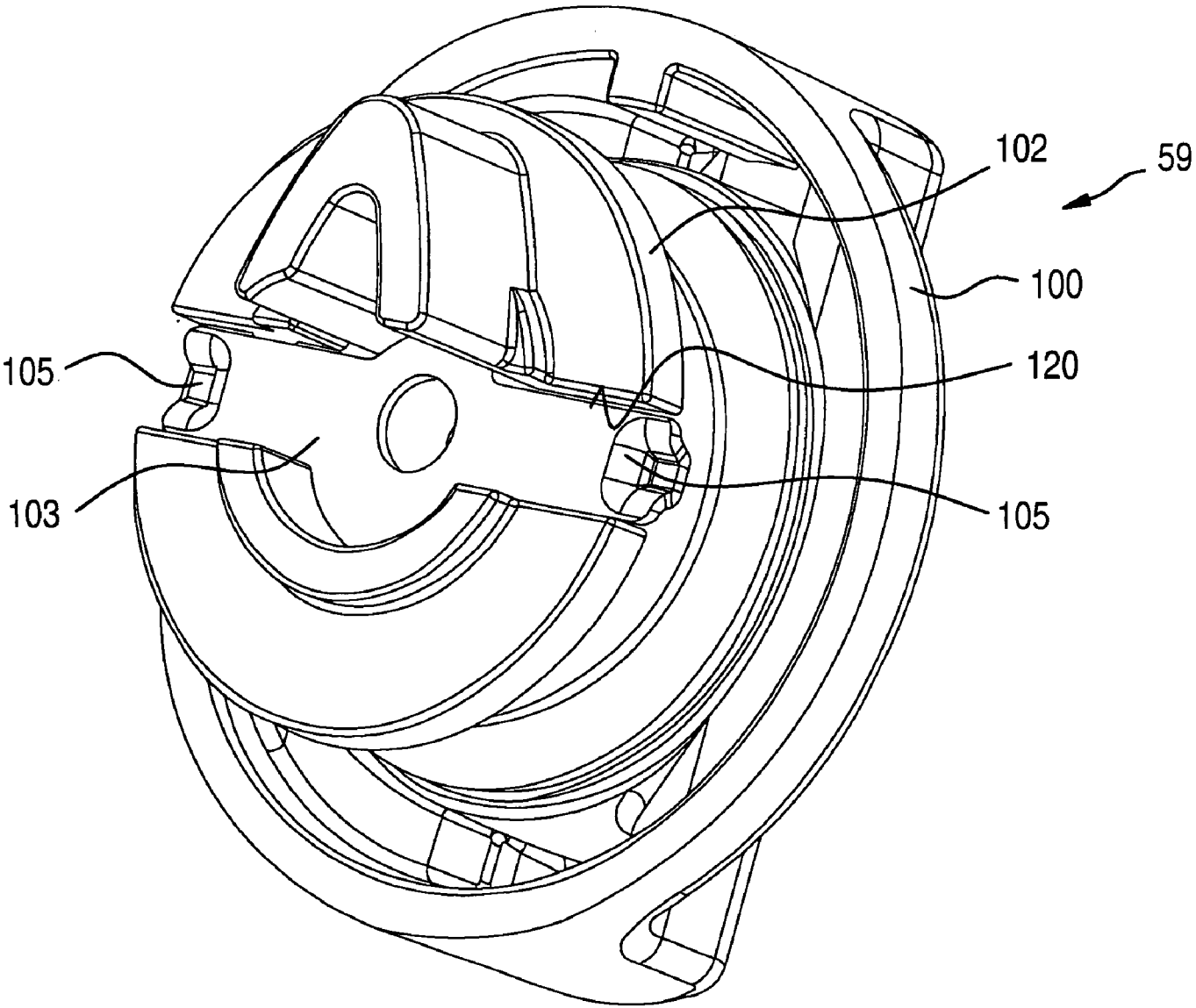
FIG. 7, a three-dimensional back view of the assembled selector element.
Figure 8:
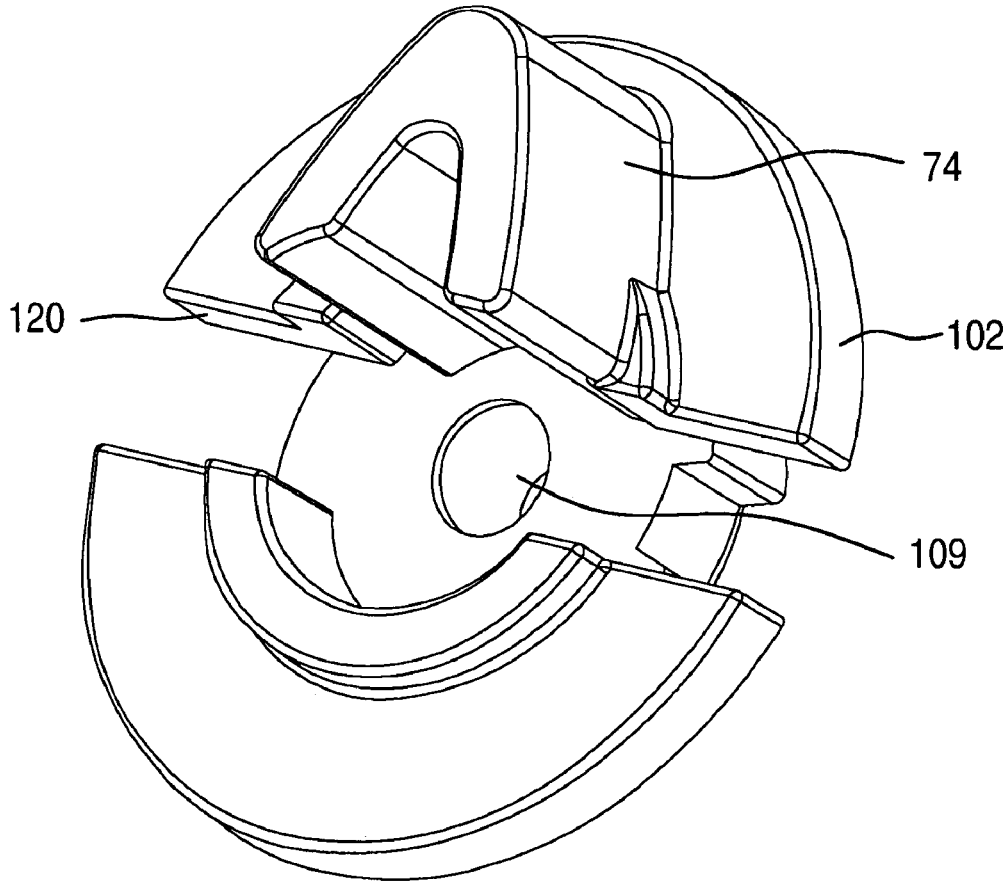
FIG. 8, a three-dimensional top view on the inner part of the selector element.
Figure 9:
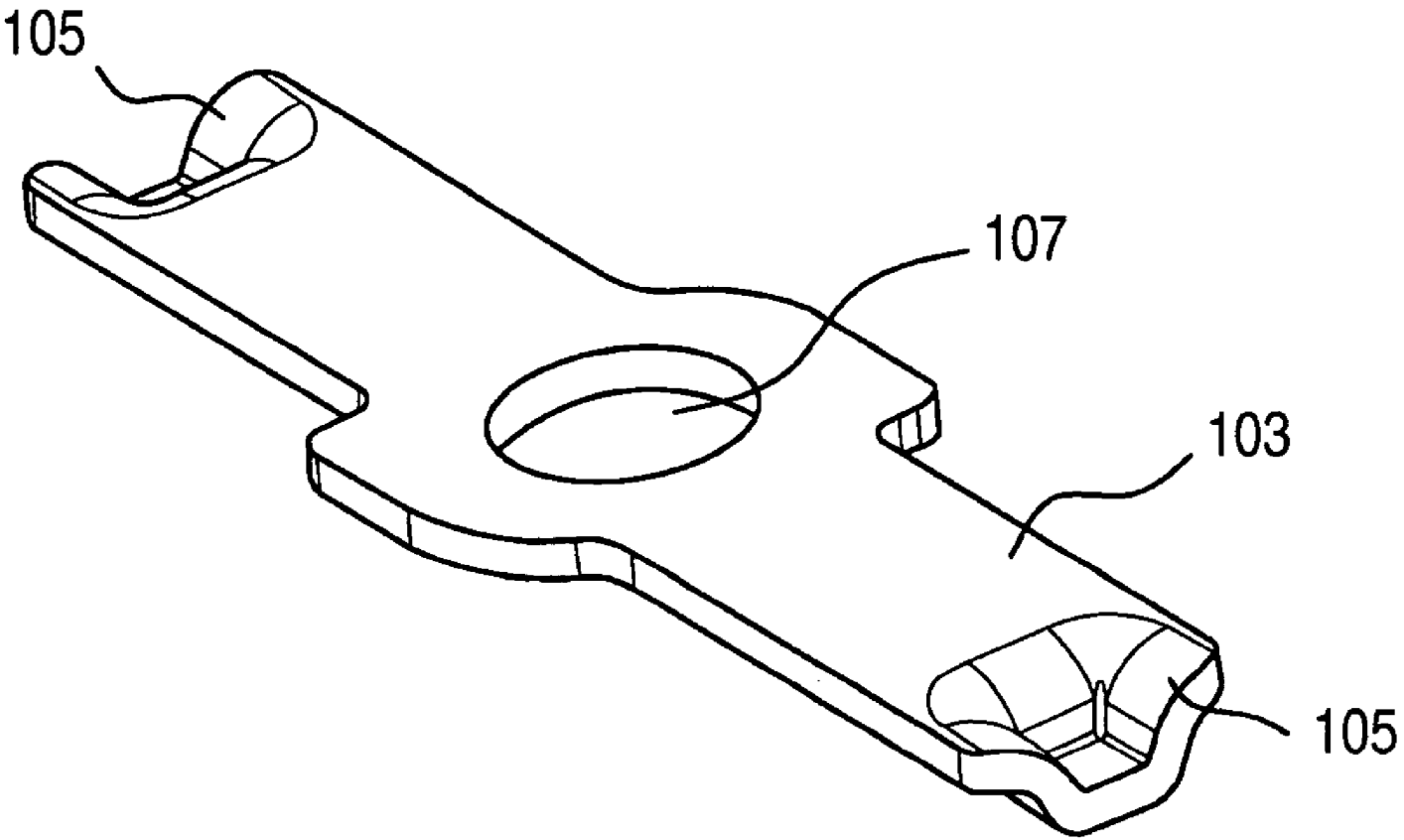
FIG. 9, a three-dimensional view of the leaf spring of the selector element.

The exploded view in FIG. 1 shows a drill hammer 10 with a housing 12; the housing comprising two half-shells 13, 14 of plastic, with a vertical parting line 15. The housing 12 receives a motor 16 with an ON/OFF switch 18 and a suitable power cord 20 for connection to an external power source, as well as a gear 26 and a percussion mechanism 36. The motor 16 includes a motor shaft 22, whose free end has a motor pinion 24 that is supported in an intermediate flange 25 that can be positionally secured between the half-shells 13, 14. The motor pinion 24 is in engagement with a driving gear wheel 30 of an intermediate shaft 28 of the gear 26, the intermediate shaft being supported by one end in the intermediate flange 25 via a needle bearing, not shown. Adjoining this, a swash gear wheel 38 is rotatably supported on the intermediate shaft 28, adjacent to a driving gear wheel 30 seated firmly on it and in particular press-fitted onto it. The swash gear wheel 38 has a swash plate 40 with a wobbling prong 42, as part of the percussion mechanism 36. Axially adjacent to the swash gear wheel 38, a slaving gear wheel 32 is seated rotatably but in a manner fixed against relative rotation on the intermediate shaft 28, in particular being press-fitted on, and the slaving gear wheel 32 is followed axially adjacent it by a driven gear wheel 35, which is axially secured by a roller bearing 45, seated firmly on the other end of the intermediate shaft 28; the slaving gear wheel 32 is embraced by a shift sleeve 34 in such a manner that it is slaved rotationally and is axially displaceable. The driven gear wheel 35 of the intermediate shaft 28 meshes with the driving gear wheel 48 of the driven shaft 46; with the gear 26, by displacement of the shift sleeve 34 with switching means 52, the rotary motion of the motor 16 can be selectively adjusted by hand by means of selector element 59 to a purely rotary motion, or in other words drilling, or a purely reciprocating motion, or in other words chiseling, or a rotary and reciprocating motion, or in other words drill hammering, of the driven shaft 46.

Adjoining the wobbling prong 42, the percussion mechanism 35 continues with a percussion element 44, which via the swash plate 40 transmits percussive energy, converted from a rotary motion to a translational motion, to a chisel or drill restrained axially displaceably on a drill chuck 50 seated on the driven shaft 46 or on the end thereof.

The shift sleeve 34 has an annular-groovelike slot 33 on its circumference, for engagement by a gearshift fork 52, which is part of a shift plate 54 designed in particular as a one-piece bent sheet-metal part. The shift plate 54 is a sheet-metal part bent into a U, the first leg of which U, with a semicircular recess, embraces the shift sleeve 34 or the slot 33, and the other leg of which U serves as a locking fork 56 and is provided with a tooth hub profile 58, located in a semicircular recess, for engagement with the serrated shaft profile of the driven gear wheel 35. In the aforementioned engagement, the driven gear wheel 35 is simultaneously released from the slaved rotation by the shift sleeve 34 and is locked in a manner secured against relative rotation. Thus with the selector element 59, a selectable rotary position of the driven shaft 46 for chiseling can be fixed. The shift plate 54 is longitudinally displaceable axially parallel to the intermediate shaft 28 via a guide rod 51, which penetrates a guide bore 53 that passes transversely through the gearshift fork 52 and the locking fork 56. For displacement of the shift plate 54, the selector element 59, on the order of a rotary knob, is used; its rotation can be transmitted, via its eccentric cam 59, as a sliding motion to a protrusion 55 of the shift plate 54.

The rotary motion of the electric motor 16 is transmitted via the driving gear wheel 30 to the intermediate shaft 28 and the slaving gear wheel 32. The slaving gear wheel, of sintered material, is in the form of a serrated shaft, whose profile extends over its entire external length. The swash gear wheel 38 can be coupled in a manner fixed against relative rotation to the slaving gear wheel 32 via the suitably positioned shift sleeve 34, and then the rotary motion of the intermediate shaft 28 is converted, via the swash plate 40 and the wobbling prong 42, into a translational motion of the percussion element 44.

The driven gear wheel 35, seated rotatably on the intermediate shaft 28, can be coupled in a manner fixed against relative rotation to the slaving gear wheel 32 via the shift sleeve 28, and part of the driven gear wheel 35 has a serrated shaft profile 31 and 66, which corresponds to the tooth hub profile 29 of the shift sleeve 28, and a further part of the driven gear wheel 35 has a spur gear profile 68 for transmitting rotation to the driving gear wheel 48 of the driven shaft 46. As a result, the rotary motion of the intermediate shaft 28 can be transmitted to the driven shaft 46 and to the drill chuck 50 secured therein, or to a tool insert in the form of a drill or chisel seated therein. The coupling or shifting between the slaving gear wheel 32 and the axially adjacent swash gear wheel 38 or driven gear wheel 35 is effected via the shift sleeve 34, whose positioning is established solely by way of the form lock between the slot 33 and the gearshift fork 52 engaging it, without any friction losses occurring in the operation of the drill hammer 10. Thus the shift sleeve 34, in all three switching positions, remains unsubjected to axial force, resulting in less wear and a longer service life.

If upon axial displacement of the shift sleeve 34 the corresponding serrated shaft/tooth hub profiles of the swash gear wheel 38 or driven gear wheel 35 meet one another on the face end with that of the shift sleeve 34, shifting synchronizing means make the shifting easier. To that end, on their side toward the slaving gear wheel 32, each of the serrated shaft profiles of the swash gear wheel 38 or driven gear wheel 35 has a parallel tooth width reduction 62, 64 of approximately ⅔ of the tooth width over a tooth length of approximately 1 to 2 mm. This leads to a partial widening of the tooth gaps of the serrated shaft profile and facilitates the entry there of the tooth hub teeth of the shift sleeve 34.

In a transitional position in shifting from the percussion drilling mode to the chiseling mode, the drill chuck 50 or the chisel can be rotated by hand into a desired working position. After the shifting to the chiseling mode shifting position, the selected rotary position of the chisel is maintained by way of the locking with the locking fork 56.

The shift travel amounts to approximately 5 mm of displacement distance of the shift sleeve 34, or rotational distance of the selector element 59 to the right or left.

The selector element 59 comprises a shell-like outer, hand-actuatable handle part 100 and an inner selector part 102, centrally fitting into the outer handle part 100, with a cam 74, with which the shifting operation for selecting a gear or changing gears is accomplished. Both parts can be screwed together on a housing shell 13 in a manner that is sealed off from the housing shell; a sealing ring 104 is held in prestressed fashion between the edge of the inner selector part 102 and the inner wall of the housing shell 13.

The inner selector part 102, on its inside, has a rectilinear, groovelike recess 120 for form-locking reception of an elongated, rectilinear leaf spring 103 with a central through hole 107 for a mounting screw 106. The outer ends of the leaf spring 103 have camlike indentations 105, which fit into corresponding associated indentations 113 on the inside of the housing shell 13 and define overloadable adjustment positions of the selector element 59.

The outer handle part 100 can be screwed to the inner selector part 102 by passing a screw through its central through hole 109 to engage a threaded hole 108 of the handle part 100. The inner selector part 102 is aligned with a centering ring 112 of the handle part 100.

The handle part 100 has a twist knob 110 protruding in beamlike fashion, which rests graspably in the user's hand and allows the handle part or the selector element 59 to be easily rotated. The housing shell 13, outside the circumference of the handle part 100, has an outward-protruding stop 114 as well as graphic symbols 116, 117, 118 that can be felt by the hand. The stop 114 corresponds to the beamlike twist knob 110, upon whose rotation, in the chiseling position, the user's hand meets the stop 114 and can tell that the chiseling position has been reached.

Thus an indexing and positional fixation of the selector element 50 and hence of the gearshifting in the selected position is assured.

The invention claimed is:

1. A portable power drill or drill hammer, comprising a housing composed of half-shells; a shiftable change-speed gear received in said housing and having a manually hand-rotatable selector element which converts a rotary motion into a shifting motion, said selector element having a circular shell-shaped outer handle part which is joinable with a further circular shell-shaped inner selector part so as to be sealed from outside and inside relative to one of said half shells, said inner selector part having a spring element which is configured as a leaf spring arranged in a form-locking fashion in said inner selector part, so that said leaf spring overlaps said selector part at both sides and is supported with both overlapping ends inside on said one half-shell, wherein said handle part and said selector part are supported outwardly and inwardly on said one semi-shell and screwed with one another, further comprising a sealing ring which is braced between an edge of said inner selector part and an inner wall of said one semi-shell axially in a position-secured manner.

2. A portable power drill or drill hammer as defined in claim 1, wherein said inner selector part is mounted centrally on said outer handle part.

3. A portable power drill or drill hammer as defined in claim 1, further comprising a central screw element for screwing said handle part and said selector part with one another.

4. A portable power drill or drill hammer as defined in claim 3, wherein said central screw is formed as a mounting screw which engages through a central through hole of said selector part into a threaded hole of said handle part.

5. A portable power drill or drill hammer as defined in claim 1, further comprising a cam for transmitting a shifting movement of a gearbox and configured of one piece with said inner selector part.

6. A portable power drill or drill hammer as defined in claim 1, wherein said handle part has a twist knob which protrudes in a beam-shaped fashion and is reliably graspable by a user's hand.

7. A portable power drill or drill hammer as defined in claim 1, wherein said one semi-shell outside a periphery of said handle part carries an outwardly projecting stop and symbols which are feelable by hand.

8. A portable power drill or drill hammer as defined in claim 1, wherein said stop corresponds to a beam-shaped twist knob, so that upon rotation, in a chiseling position, a user's hand meets said stop.

9. A portable power drill or drill hammer, comprising a housing composed of half-shells; a shiftable change-speed gear received in said housing and having a manually hand-rotatable selector element which converts a rotary motion into a shifting motion, said selector element having a circular shell-shaped outer handle part which is joinable with a further circular shell-shaped inner selector part so as to be sealed from outside and inside relative to one of said half shells, said inner selector part having a spring element which is configured as a leaf spring arranged in a form-locking fashion in said inner selector part, so that said leaf spring overlaps said selector part at both sides and is supported with both overlapping ends inside on said one half-shell, wherein said inner selector part on its inner side has a diametrically extending, straight, groove-shaped opening for a form-locking reception of said leaf spring, formed as an elongated, straight leaf spring with a central through hole for a mounting screw.

10. A portable power drill or drill hammer as defined in claim 9, wherein said leaf spring has outer ends provided with cam-shaped indentations which fit in corresponding indentations on an inner side of said one half-shell and define overloadable adjustment positions of said selector element.

11. A portable power drill or drill hammer, comprising a housing composed of half-shells; a shiftable change-speed gear received in said housing and having a manually hand-rotatable selector element which converts a rotary motion into a shifting motion, said selector element having a circular shell-shaped outer handle part which is joinable with a further circular shell-shaped inner selector part so as to be sealed from outside and inside relative to one of said half shells, said inner selector part having a spring element which is configured as a leaf spring arranged in a form-locking fashion in said inner selector part, so that said leaf spring overlaps said selector part at both sides and is supported with both overlapping ends inside on said one half-shell, wherein said one semi-shell has an inner counter surface which is configured as a support surface for said spring element, wherein said counter surface is ring-shaped and has at least two uniformly spaced indentations for engagement of ends of said spring element.

12. A portable power drill or drill hammer as defined in claim 11, wherein said counter surface has four said indentations.

* * * * *